United States Patent [19]

Black

[11] 4,281,836

[45] Aug. 4, 1981

[54] DARTBOARD SAFETY SURROUND

[76] Inventor: Ronald M. F. Black, 63 Grassendale Ave., North Prospect, Plymouth, Devon, England

[21] Appl. No.: 118,777

[22] Filed: Feb. 5, 1980

[51] Int. Cl.[3] ..... F41J 3/00

[52] U.S. Cl. ..... 273/408; 273/DIG. 2; 273/DIG. 4; 273/DIG. 8

[58] Field of Search ..... 273/403, 404, 408, 425, 273/DIG. 2, DIG. 4, DIG. 8

[56] References Cited

U.S. PATENT DOCUMENTS

| | | | |
|---|---|---|---|
| 3,300,216 | 1/1967 | Haecker | 273/403 |
| 3,309,091 | 3/1967 | Haecker | 273/408 |

FOREIGN PATENT DOCUMENTS

| | | |
|---|---|---|
| 528121 | 10/1940 | United Kingdom . |
| 1020847 | 2/1966 | United Kingdom . |
| 1022343 | 3/1966 | United Kingdom . |
| 1101394 | 1/1968 | United Kingdom . |
| 1167384 | 10/1969 | United Kingdom . |

*Primary Examiner*—Anton O. Oechsle

*Attorney, Agent, or Firm*—Thomas J. Greer, Jr.

[57] ABSTRACT

A dartboard safety surround for receiving badly-aimed darts which narrowly miss the dartboard comprises an annular element of an elastomeric material such as, for example, a polyether urethane elastomer, which is dense enough to hold darts piercing the element and which resiliently grips the periphery of the dartboard. The rear face of the annular element defines a recess which is occupied by a filler having a density less than the elastomer of the annular element.

11 Claims, 3 Drawing Figures

DARTBOARD SAFETY SURROUND

BACKGROUND OF THE INVENTION

The present invention relates to dartboard safety surrounds.

When a dartboard is mounted in a relatively fixed position, for example on a wall, the area of the wall immediately surrounding the dartboard is subject to considerable damage from the impact of badly-aimed darts which narrowly miss the board. This necessitates frequent redecoration of this area, and also constitutes a safety hazard in that a hard wall surface will not allow the darts to penetrate (athough being dented, scratched and otherwise damaged) and badly-aimed darts are, therefore, likely to rebound or glance off the wall surface, constituting a hazard for any spectators or other people standing in the vicinity of the dartboard.

OBJECT OF THE INVENTION

It is the object of the present invention to provide a dartboard safety surround for receiving badly-aimed darts which narrowly miss the dartboard, thereby protecting the area immediately around the dartboard from damage, and reducing substantially the risk of injury to spectators by rebounding darts.

SUMMARY OF THE INVENTION

The present invention provides a dartboard safety surround comprising an annular element of solid resilient material having one radial face, in use of the front face, with a radial dimension greater than the thickness of the element, and a recess in the radial face opposite the said one face, the recess being occupied by a filler.

A dartboard safety surround must be dense enough to hold darts when pierced thereby, but not so dense that there is any significant chance of impinging darts glancing off or rebounding from the surround. The resilience is necessary in order to obtain the required gripping of the darts when the surround is pierced by the shaft point thereof.

Preferably, the radially inner part of the annular element is thicker than the radially outer part thereof, since the majority of darts missing the board will fall closer to the board rather than further away, and also because the thickened part serves as a stiffening element.

The filler preferably comprises a material having a density which is less than that of the resilient material of the annular element, thereby economising on the denser material of the annular element.

In one embodiment of the invention the annular element comprises a radially inner thickened part from which projects outwardly a radial flange, the radial flange preferably tapering outwardly. In such an embodiment the recess behind the said flange may also be occupied by a filler of material the density of which is less than that of the resilient material of the annular element.

Suitable materials for the filler include polyurethane foam, polyethylene foam, and expanded polystyrene. Polyurethane foam is particularly suitable since it can be foamed in situ and will adhere to the annular element by its own natural adhesion. Likewise, expanded polystyrene may be expanded in situ.

A suitable material for the annular element is a cold-cure polyether urethane elastomer, and it is preferred that the shore hardness of the material of the annular element lies in the range 60°A–75°A. Likewise, the density of the material of the annular element preferably lies in the range 1.25 g/cm$^3$–1.75 g/cm$^3$, and it is preferred that the density of the filler material lies in the range 25 kg/m$^3$–40 kg/m$^3$.

The present invention also comprehends a dartboard assembly comprising a dartboard and a dartboard safety surround as defined herein. Preferably, the inner diameter of the annular element which comprises the dartboard safety surround is slightly less than the outer diameter of the dartboard, and is held in position by resiliently stretching the annular element to fit over the dartboard.

Other features and advantages of the present invention will become apparent from a consideration of the following description of the two preferred embodiments made, by way of example, with reference to the accompanying drawings.

DESCRIPTION OF THE PREFERRED EMBODIMENTS

Figure 1:
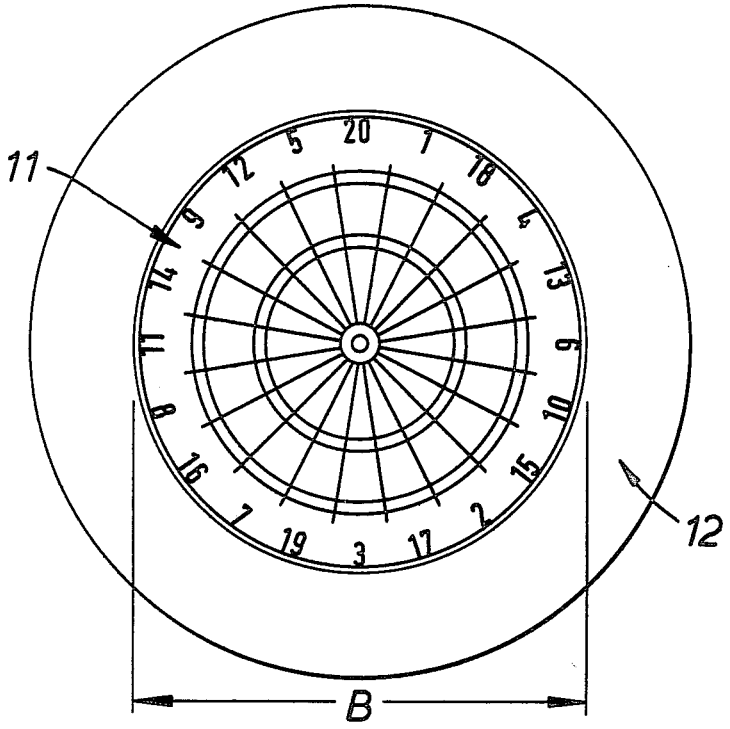
FIG. 1 is a general frontal view of a dartboard provided with a safety surround formed according to either embodiment.

FIG. 1 illustrates generally a dartboard 11, the rim of which has been fitted with a dartboard safety surround 12 according to an embodiment of the present invention.

Figure 2:
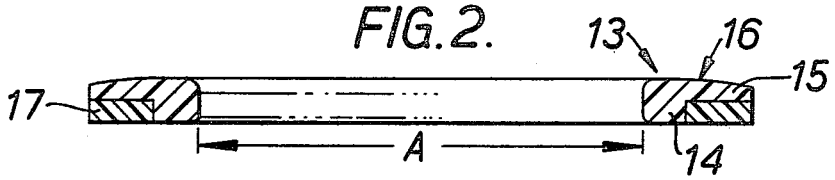
FIG. 2 is an axial section of a first embodiment.

As can be seen in FIG. 2, this dartboard safety surround comprises an annular element 13 which is made from polyether urethane elastomer with an inner diameter A in the region of 1–2 cms. smaller than the diameter of the dartboard 11, indicated B in FIG. 1. The annular element 13 comprises a radially inner thicker part 14 from which projects an outwardly-tapering radial flange 15 having one radial face 16 which is common with the radial face of the thickened part 14. The radial face 16 constitutes the front face of the annular element and, in use of the dartboard safety surround 12, receives any darts which narrowly miss the dartboard 11.

The recess behind the radial flange 15 is occupied by an annular element 17 of expanded polystyrene which is secured to the annular element 13 by adhesive, or by its own natural adhesion if it is expanded in situ. The expanded polystyrene element 17 has a generally rectangular cross section and serves as a reinforcing filler element for the flange 15, permitting an economy in the use of the polyether urethane elastomer of which the annular element 13 is composed.

Figure 3:
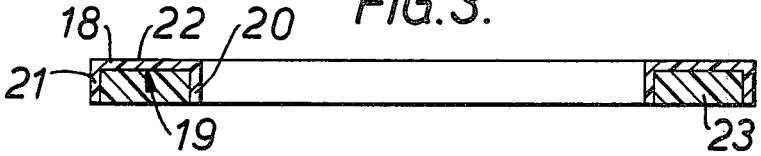
FIG. 3 is an axial section, similar to FIG. 2, of a second embodiment.

The dartboard safety surround 12 illustrated in FIG. 3 comprises an annular element 18 having, in its rear face, a recess 19 which is defined between two axial flanges 20, 21 separated by a radial web 22. The radial face of the web 22 remote from the flanges 20, 21 constitutes the front face of the element, facing forwardly in use of the dartboard safety surround to receive darts narrowly missing the dartboard. The annular recess or channel 19 is occupied by a rectangular section annular reinforcing filler element 23 which is substantially identical to the filler element 17 in FIG. 2, but of slightly smaller outer diameter.

The dartboard safety surrounds illustrated in FIGS. 2 and 3 are fitted onto a dartboard, such as the dartboard 11, by stretching the resilient annular element over the dartboard so that it grips the perimeter tightly and is held in place without requiring any other fixing. The polyether urethane elastomer of which the annular element is composed preferably has a density of 1.45 $gm/cm^3$, although this may vary within a range of 1.25 $g/cm^3$ to 1.75 $g/cm^3$. Likewise, the shore hardness of the elastomer is preferably in the vicinity of 68°A although it may vary within the range 60°A to 75°A.

The density of the filler material is preferably 32 $kg/m^3$, although this may vary in the range 25 $kg/m^3$ to 40 $kg/m^3$ depending on the foaming or expanding conditions.

I claim:

1. A dartboard safety surround comprising: an annular element of solid resilient material having a radial front face with a radial dimension greater than the thickness of said element and a radial rear face defining an annular recess, and a filler which occupies said recess.

2. A dartboard safety surround as defined in claim 1, wherein said annular element has a radially inner part and a radially outer part which is thinner than said radially inner part.

3. A dartboard safety surround as defined in claim 2, wherein said radially outer part comprises an outwardly projecting radial flange.

4. A dartboard safety surround as defined in claim 3, wherein said radial flange tapers radially outwardly.

5. A dartboard safety surround as defined in claim 1, wherein said annular element is further formed with inner and outer annular flanges, extending axially from said radial rear face, said filler being located between said flanges.

6. A dartboard safety surround as defined in claim 1, wherein said filler comprises a material having a density which is less than that of said resilient material of said annular element.

7. A dartboard safety surround as claimed in claim 6, wherein which said filler material is chosen from one of the following: polyurethane foam, polyethylene foam, and expanded polystyrene.

8. A dartboard safety surround as claimed in claim 7, in which the filler material is expanded in said recess and adheres to the annular element by its own adhesion.

9. A dartboard safety surround as defined in any preceding claim, wherein said annular element is composed of a polyether urethane elastomer.

10. A dartboard assembly including a dartboard and a dartboard safety surround comprising: an annular element of solid resilient material having a radial front face with a radial dimension greater than the thickness of said element and a radial rear face defining an annular recess, and a filler which occupies said recess.

11. A dartboard assembly as defined in claim 10, wherein the inner diameter of said annular element is slightly less than the outer diameter of said dartboard and is held in position by tension in said annular element.

* * * * *